US005632662A

United States Patent [19]

Cadorette

[11] Patent Number: 5,632,662

[45] Date of Patent: May 27, 1997

[54] CENTRALLY ARTICULATED SWIN FIN

[76] Inventor: Ron Cadorette, 485 Viceroy Road, North Bay, Ontario, Canada, P1B 8G4

[21] Appl. No.: 701,795

[22] Filed: Aug. 26, 1996

[51] Int. Cl.[6] ..... A63B 31/08

[52] U.S. Cl. ..... 441/63; 441/64

[58] Field of Search ..... 441/61–64; D21/239

[56] References Cited

U.S. PATENT DOCUMENTS

| | | | |
|---|---|---|---|
| 3,171,142 | 3/1965 | Auzols | 9/309 |
| 3,268,927 | 8/1966 | Markowitz | 441/63 |
| 3,302,223 | 2/1967 | Ciccotelli | 9/309 |
| 3,315,286 | 4/1967 | Brion | 9/304 |
| 4,017,925 | 4/1977 | Shamlian | 9/309 |
| 5,083,954 | 1/1992 | Jacobs | 441/64 |
| 5,108,327 | 4/1992 | Klein | 441/64 |
| 5,447,457 | 9/1995 | Kamitani | 441/64 |

*Primary Examiner*—Edwin L. Swinehart
*Attorney, Agent, or Firm*—Merek & Voorhees

[57] ABSTRACT

A swim fin is disclosed that comprises a boot portion to receive the foot of a swimmer, a web portion, and a pair of side members. Each of the side members have an upper and lower arm and an upper and lower end. The lower ends of the side members are attached to opposite sides of the web portion while the upper ends of the side members attached to a leg engaging strap. A pivot means connects the side members to the boot portion and permits the side members and the web portion to rotate about the boot portion such that when the leg engaging strap is attached to the lower leg of a swimmer the web portion is pivoted to a position approximately parallel to the swimmer's lower leg.

13 Claims, 5 Drawing Sheets

CENTRALLY ARTICULATED SWIN FIN

FIELD OF THE INVENTION

This invention relates to swim fins as may be worn on the feet of swimmers to aid or assist in their propulsion through water.

BACKGROUND OF THE INVENTION

Swim fins are typically worn by swimmers in order to provide a means to increase their mode of propulsion through water. Most commonly the fins comprise a web portion that is attached by means of a boot to the swimmer's foot to increase the amount of water displaced through the kicking movement and thereby increasing acceleration and propulsion. While traditional swim fins are somewhat effective in these regards, they suffer from the inherent limitation of causing excessive ankle and foot stress and fatigue when used for an extended length of time. That is, when using traditional fins the swimmer's ankle is normally extended with the toes pointing outwardly in line with the upper leg. In that fashion the web portion of the fin provides forward thrust; however, at the same time can cause fatigue of the ankle muscles and puts a considerable amount of strain on the joints and ligaments of the ankle and foot. After a length of time the added stress upon the ankle can cause cramping, particularly in novice or beginner swimmers.

SUMMARY OF THE INVENTION

The invention therefore provides a swim fin that overcomes the limitations of the prior art by providing a web portion that is pivotal about a hinge joint in order to allow for the creation of forward propulsion during the kicking movement while at the same time relieving stress and strain imposed upon the ankle and foot. The swim fin of the present invention also may be readily converted back to a conventional fin structure for purposes of walking on land.

Accordingly, in one of its aspects the invention provides a swim fin comprising: a boot portion to receive the foot of a swimmer; a web portion; a pair of side members, each of said side members having upper and lower arms and upper and lower ends, said lower ends of said side members attached to opposite sides of said web portion, said upper ends of said side members attached to leg engaging means; and, pivot means connecting said side members to said boot portion, said pivot means permitting said side members and said web portion to rotate about said boot portion such that when said leg engaging means is attached to the lower leg of a swimmer said web portion is pivoted to a position approximately parallel to the swimmer's lower leg.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
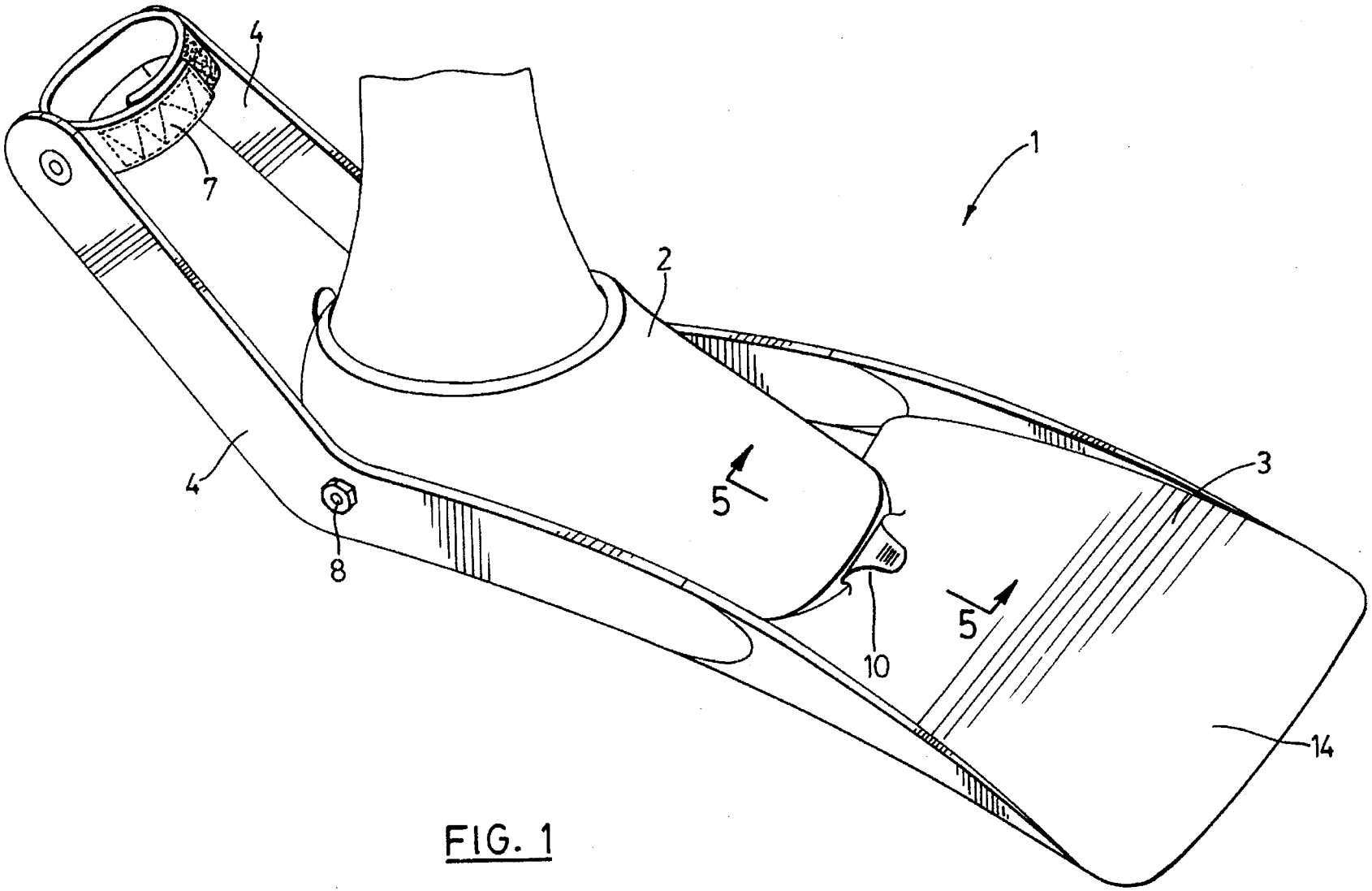
FIG. 1 is an upper side perspective view of the swim fin according to the present invention.

The swim fin of the present invention and as shown in the attached drawings is noted generally by the reference numeral 1. Swim fin 1 is comprised generally of a boot portion 2, a web portion 3 and a pair of side members 4. As shown in FIG. 1, side members 4 are elongate structural members having upper and lower ends 5 and 6, respectively, and upper and lower arms 19 and 20. The lower ends 6 of side members 4 may be attached to opposite sides of web portion 3 through molding web portion 3 around ends 6 where web portion 3 is comprised of a moldable material. Alternatively, side members 6 may be connected to web portion 3 through the use of any suitable fastener, including screws, rivets, bolts and pins. Upper ends 5 of side members 4 are attached to a leg engaging means 7 that are used to attach side members 4 to the lower leg of a swimmer.

Side members 4 are also connected to boot portion 2 by way of a pivot means 8 that permits side members 4, together with web portion 3, to rotate about boot portion 2. In the preferred embodiment upper and lower arms 19 and 20 of side members 4 meet at a pivot point 9 and form a generally obtuse angle therebetween. Pivot point 9 corresponds to the position along side members 4 through which pivot means 8 connects the side members to boot portion 2. It will be appreciated that through this particular structure pivot point 9 acts as a fulcrum and a point around which side members 4 and web portion 3 may be rotated.

Figure 2:
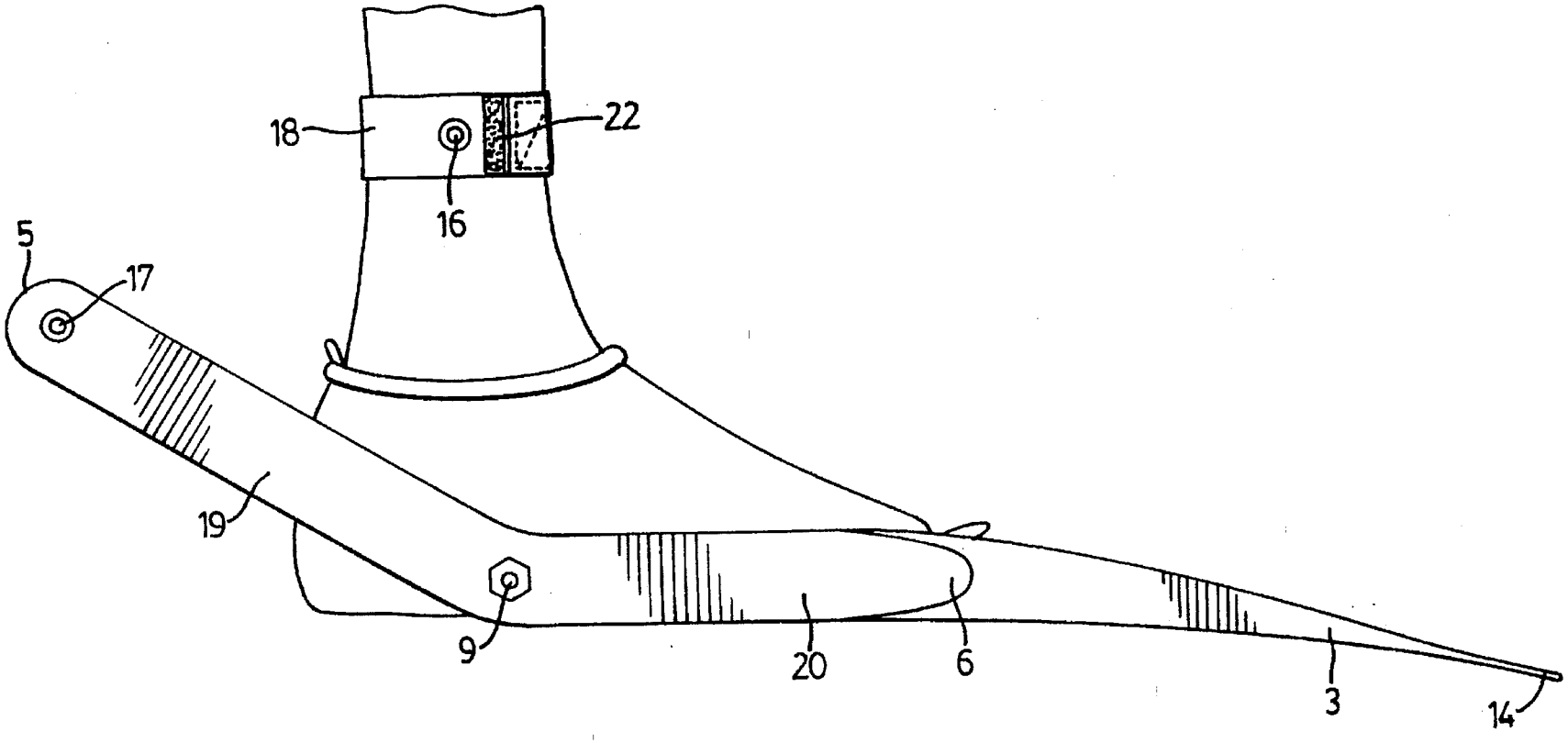
FIG. 2 is a side view of the swim fin shown in FIG. 1.
Figure 3:
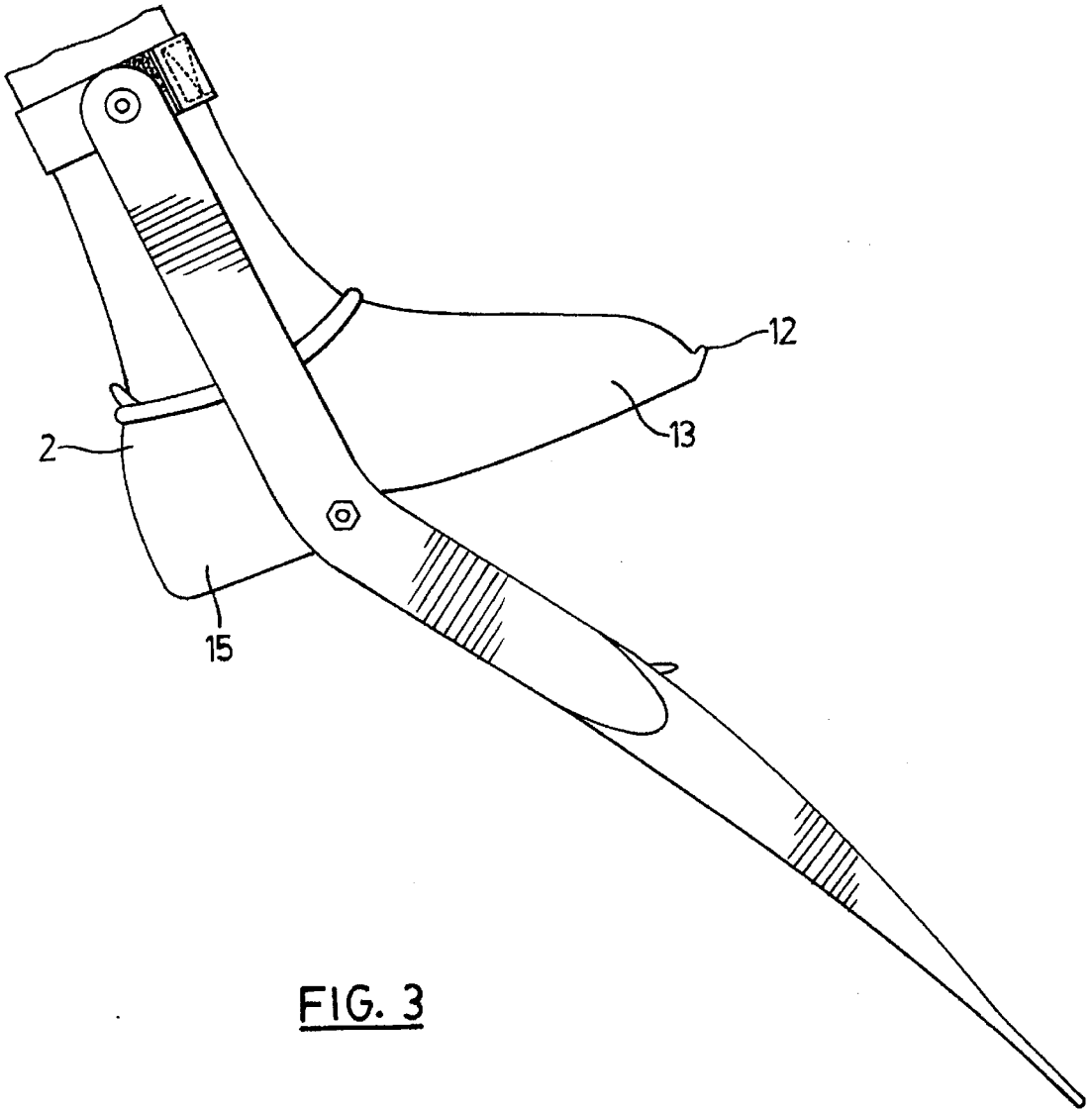
FIG. 3 is a side view of the swim fin of FIG. 1 with its web in an extended position.

It will be understood that when leg engaging means 7 is attached to the lower leg or calf of a swimmer, web portion 3 will be pivoted away from boot portion 2 to a position that approaches a plane parallel to the swimmer's lower leg. This particular embodiment is shown more clearly in FIGS. 3 and 4. Similarly, and as shown in FIGS. 1 and 2, when leg engaging means 7 is released from the lower leg or calf of a swimmer side members 4 and web portion 3 are free to rotate back such that web portion 3 is in the same general plane as boot portion 2. In this manner the swim fin 1 takes on the configuration of a more traditional or standard type of fin, the major difference being that side members 4 will extend outwardly from the swimmer's heel as shown in FIG. 1.

Figure 5:
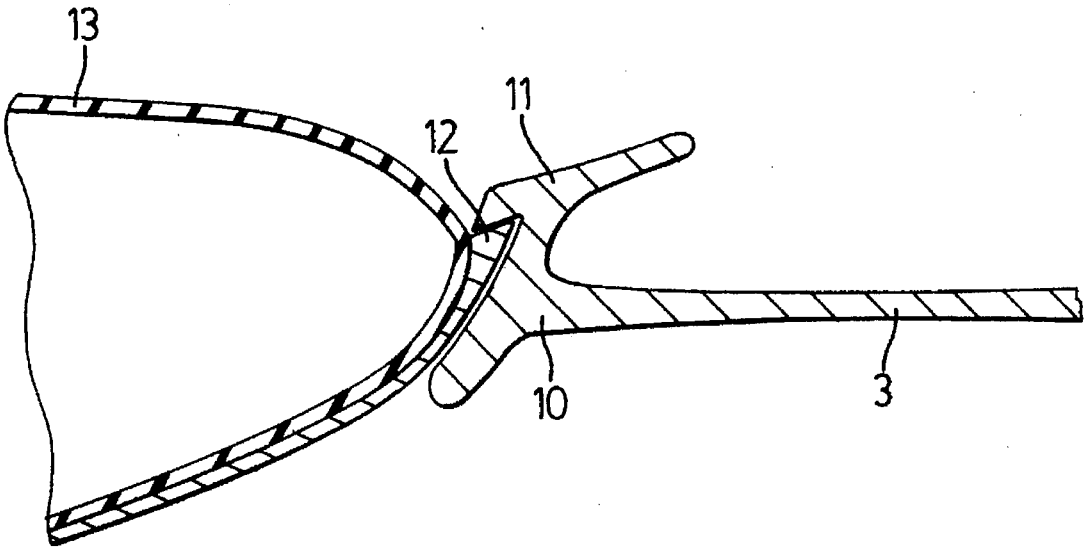

To facilitate in walking on land when wearing swim fins 1, fins 1 also include retaining means 10 to releasably secure web portion 3 to boot portion 2. Retaining means 10 helps to prevent pivotal movement of side members 4 and web portion 3 about boot portion 2 and to secure web portion 3 in place while walking. Referring specifically to FIGS. 1 and 5, retaining means 10 preferably comprises a hook member 11 that is attached to web portion 3 and that extends upwardly therefrom. Hook 11 is releasably securable to a lip member 12 which extends outwardly from the toe 13 of boot portion 2. When web portion 3 is rotated upwardly such that it is in generally the same plane as boot portion 2, hook member 11 will be secured over lip 12 thereby maintaining web portion 3 in place and restricting pivotal movement of side members 4. In addition to facilitating walking on land, retaining means 10 will also securely hold web portion 3 in generally the same plane as boot portion 2 in the event that a swimmer wishes to utilize the fins in a traditional manner.

In the preferred embodiment web portion 3 is comprised of a rubber, plastic or other flexibly resilient or elastomeric material such as those from which swim fins are most commonly made. Hook member 11 is preferably comprised of the same flexibly resilient material and is of unitary construction with web portion 3. Through constructing hook member 11 from a flexibly resilient material it can be displaced from lip member 12 thorough manually grasping the hook and pulling it outward toward the lower end 14 of web portion 3. Once hook member 11 has been pulled outwardly such that it no longer engages lip member 12, side members 4 may be pivoted to rotate web portion 3 downwardly away from boot portion 2. Leg engaging means 7 can then be attached to the swimmer's lower leg or calf.

Similarly, in order to releasably secure web portion 3 to boot portion 2 leg engaging means 7 is first released from the swimmer's leg and side members 4 are rotated such that web portion 3 is brought upwardly into the same general plane as boot portion 2. As web portion 3 is rotated upwardly hook member 11 will be displaced toward lower end 14 of web portion 3 through coming into contact with the toe of boot portion 2. Once hook 11 has been pushed upwardly past lip member 12 its resiliency will enable it to spring back over lip member 12 thereby securing web portion 3 in place. To facilitate in the smooth interaction between hook member 11 and boot portion 2, that part of toe 13 immediately beneath lip member 12 is generally rounded and slopes inwardly toward the heal of boot portion 2. This sloping structure allows hook member 11 to be more easily slid into place to secure web 3.

Figure 4:
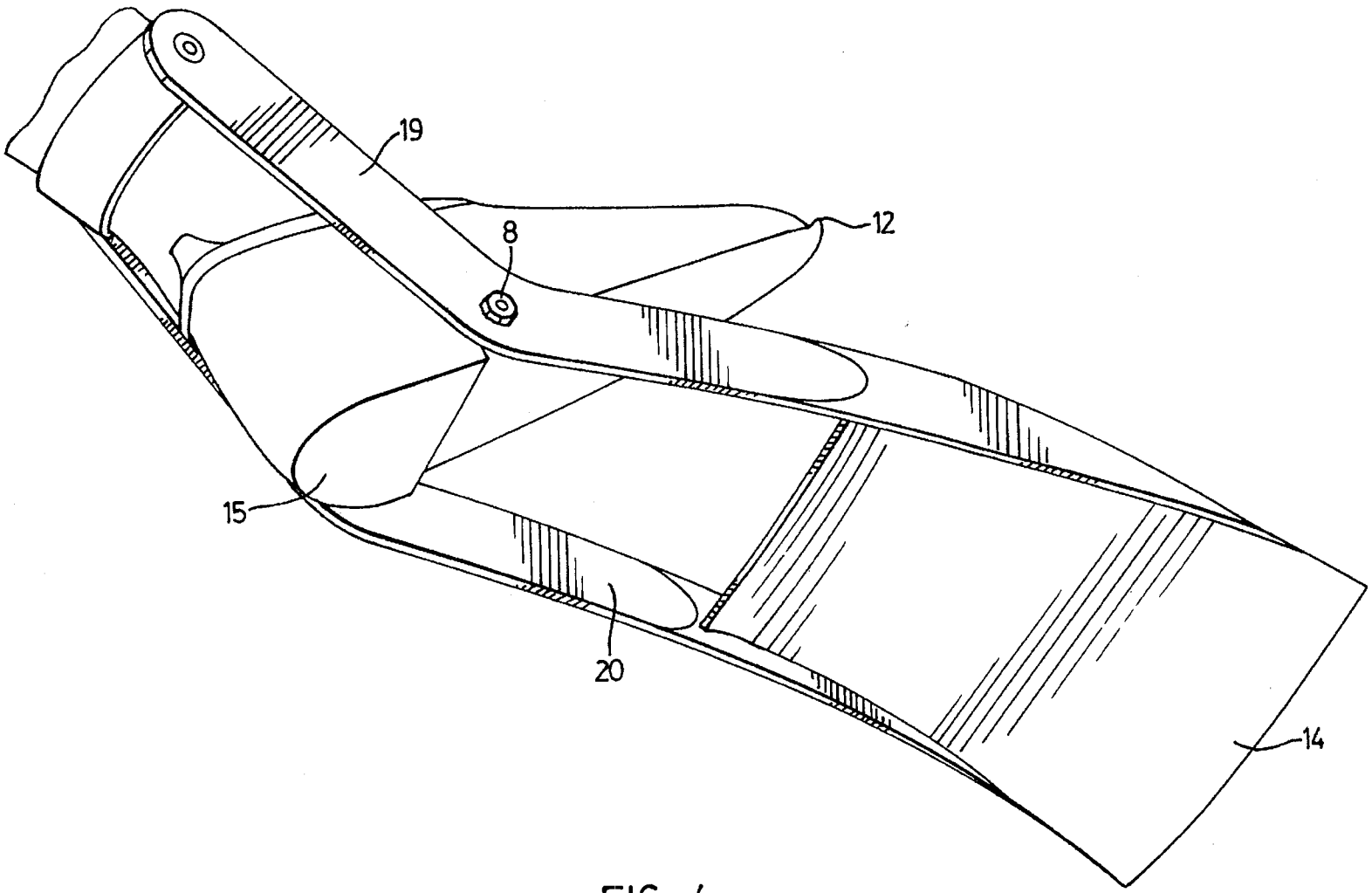
FIG. 4 is a lower perspective view of the swim fin shown in FIG. 3; and, FIG. 5 is a sectional view taken along the line 5—5 of FIG. 1.

Boot portion 2 is preferably in the form of an enclosed boot which fits snugly around the foot of a swimmer. Typically boot portion 2 would be comprised of plastic, rubber, neoprene or other waterproof or synthetic material and is stretched over the swimmer's foot or held in place through the use of straps, laces or buckles. As shown in FIG. 4, the heel 15 of boot portion 2 is reinforced in order to accommodate pivot means 8. In one embodiment pivot means 8 comprises an axle that passes through both side members 4 and is embedded within heel 15. In an alternate embodiment pivot means 8 comprises two pivot pins, one pin passing through each of the side members 4 and embedded into heel 15 to secure the side members in place. In a third embodiment, pivot means 8 comprises a pair of posts that are formed integrally with heel 15 and extend outwardly from either side thereof. These posts are then received into corresponding holes in side members 4 to pivotally secure the side members in place. Regardless of whether pivot means 8 is comprised of an axle, a pair of pivot pins, or a pair of posts extending outwardly from heel 15, as is apparent from FIGS. 3 and 4 pivot means 8 is positioned such that it secures side members 4 to boot portion 2 slightly ahead of heel 15. This will ensure that pivot means 8 is aligned directly beneath the swimmer's leg such that when leg engaging means 7 is attached to the swimmer's leg upper arms 19 of side members 4 will be approximately parallel to the lower leg.

For ease of use leg engaging means 7 is preferably comprised of a strap 18 that is attached to upper ends 5 of side members 4. Strap 18 may contain a hook and loop fastener 22 for quick attachment and removal or may be held in place around the swimmer's leg through the use of laces, buckles, snaps or other well known methods of attachment. In addition, leg engaging means 7 may also be fitted with domes or snaps 16 which mesh with corresponding domes or snaps 17 on upper ends 5 of side members 4. Domes and snaps 16 and 17 will provide the swimmer with the option of engaging or disengaging side members 4 from strap 18 without having to remove the strap from around his or her lower leg.

In the preferred embodiment side members 4 are comprised of a rigid material (such as fibreglass or rigid plastic) that permits the transmission of force directly from the swimmer's lower leg to web portion 3 without placing stress or strain upon the swimmer's ankle or foot. That is, through rotating web portion 2 downwardly and attaching leg engaging means 7 to the swimmer's lower leg, forward propulsion can be created without interaction with the swimmer's foot or ankle. As shown more clearly in FIGS. 3 and 4, when leg engaging means 7 is attached to the swimmer's leg web portion 3 is in a position that is approximately parallel to the swimmer's leg. The implementation of pivot means 8 enables the swimmer's ankle to freely move in any direction or position while swimming without having a significant effect upon forward propulsion or the operation of web portion 3.

It will therefore be appreciated that this particular structure facilitates in the creation of forward propulsion while at the same time removes stress and strain that may be placed upon the ankle joint and reduces the possibility of cramping. Stress on the ankle and foot is eliminated through removing the necessity for ankle or foot movement while using the fins. Swimming efficiency is maintained by ensuring that the web of the swim fin is approximately in line with the swimmer's leg such that its range of movement is optimized during the kicking process. The angle $\alpha$ between upper and lower arms 19 and 20 of side members 4 will determine the position of web portion 3 during use. To optimize forward propulsion it has been found that this angle is preferably in a range of between 140 and 160 degrees.

The mechanics of the swimming motion are such that preferably the swimmer's knees are straight with movement concentrated at the hip joints. When utilizing traditional swim fins the swimmer's toes are pointed in order to place the fin in a position that is approximately parallel with the swimmer's legs. The swim fin of the present invention therefore reduces the need for the swimmer to point his or her toes and allows for the foot to move independently of web portion 3. Through attaching leg engaging means 7 to the swimmer's lower leg, web portion 3 is held in an optimum position and angle of attack for maximizing forward propulsion.

It is to be understood that what has been described are the preferred embodiments of the invention and that it is possible to make variations to these embodiments while staying within the broad scope of the invention. Some of these variations have been discussed while others will be readily apparent to those skilled in the art. For example, while retaining means 10 has been described as a hook member 11 that extends upwardly from web portion 3 and engages lip member 12, it will be appreciated by those skilled in the art that retaining means 10 could also comprise a frictional engagement between the outer sides of boot portion 2 and the inner walls of side members 4.

I claim:

1. A swim fin comprising:

a boot portion to receive the foot of a swimmer;

a web portion;

a pair of side members, each of said side members having upper and lower arms and upper and lower ends, said lower ends of said side members attached to opposite sides of said web portion, said upper ends of said side members attached to leg engaging means; and, pivot means connecting said side members to said boot portion, said pivot means permitting said side members and said web portion to rotate about said boot portion such that when said leg engaging means is attached to the lower leg of a swimmer said web portion is pivoted to a position approximately parallel to the swimmer's lower leg.

2. A swim fin as claimed in claim 1 including retaining means to releasably secure said web portion to said boot portion to prevent pivotal movement therebetween.

3. A swim fin as claimed in claim 2 wherein said retaining means comprises a hook member on said web portion, said hook member releasably attachable to a lip member extending outwardly from the toe of said boot portion.

4. A swim fin as claimed in claim 3 wherein said upper and lower arms of said side members form an obtuse angle therebetween and converge at a pivot point, said pivot point corresponding to the position through which said pivot means connects said side members to said boot portion.

5. A swim fin as claimed in claim 4 wherein said side members are formed from a rigid material to allow for the transmission of energy directly from the swimmer's lower leg to said web portion without flexure of the swimmer's ankle joint.

6. A swim fin as claimed in claim 5 wherein said leg engaging means comprises a strap attached to said upper ends of said side members.

7. A swim fin as claimed in claim 6 wherein said pivot means connects said side members to said boot portion at a position on the sole and just ahead of the heel of said boot portion.

8. A swim fin as claimed in claim 7 wherein said pivot means comprises an axle extending through said side members and said boot portion.

9. A swim fin as claimed in claim 7 wherein said pivot means comprises a pair of pivot pins, one of said pivot pins passing through each of said side members and into said boot portion.

10. A swim fin as claimed in claim 7 wherein said pivot means comprises a pair of posts that are formed integrally with said boot portion, said posts extending outwardly from either side of said boot portion to pivotally engage and secure said side members to said boot portion.

11. A swim fin as claimed in claim 8 wherein said obtuse angle between said upper and lower arms of said side members is in the range of between 140 and 160 degrees.

12. A swim fin as claimed in claim 11 wherein said strap is releasably securable to said upper ends of said side members.

13. A swim fin as claimed in claim 12 wherein said strap includes a hook and loop fastener, a buckle or a snap.

* * * * *